US007836932B2

(12) United States Patent
Lucht

(10) Patent No.: US 7,836,932 B2
(45) Date of Patent: Nov. 23, 2010

(54) TAPING HEAD

(75) Inventor: Steven G. Lucht, Inver Grove Heights, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 647 days.

(21) Appl. No.: 11/855,452

(22) Filed: Sep. 14, 2007

(65) Prior Publication Data

US 2009/0072071 A1 Mar. 19, 2009

(51) Int. Cl.
*B32B 37/10* (2006.01)
*B24D 13/00* (2006.01)

(52) U.S. Cl. ..... 156/479; 156/250; 156/252; 156/256; 156/475; 156/478; 156/480; 156/486; 156/487; 156/488; 156/489; 156/493; 156/516; 156/517

(58) Field of Classification Search ..... 156/250, 156/252, 256, 475, 478–480, 486–489, 493, 156/516, 517
See application file for complete search history.

(56) References Cited

U.S. PATENT DOCUMENTS 3,079,977 A 3/1963 Larkin
3,617,412 A 11/1971 Schenderling et al.
3,765,992 A 10/1973 Stageberg
3,929,552 A 12/1975 Bettenhausen et al.
3,992,244 A 11/1976 Craig et al.
4,001,072 A 1/1977 deNeui
4,096,022 A 6/1978 Crawford
4,182,645 A 1/1980 Hill
4,642,157 A * 2/1987 Cavanagh ..... 156/468
4,781,782 A 11/1988 Luhman et al.
4,789,418 A * 12/1988 Rayl ..... 156/468
4,936,945 A * 6/1990 Marchetti ..... 156/468
5,068,004 A 11/1991 Moll
5,192,385 A 3/1993 Moll
5,223,075 A * 6/1993 Sims ..... 156/468
5,228,943 A 7/1993 Vasilakes
5,354,410 A 10/1994 Cohen et al.
5,431,767 A 7/1995 Koza et al.
5,482,593 A 1/1996 Kuhn et al.
5,658,420 A 8/1997 Rossini
5,779,181 A 7/1998 Nakae et al.
5,791,586 A 8/1998 Cayford et al.
5,814,184 A 9/1998 Denkins
6,024,148 A 2/2000 Saitoh et al.
6,571,849 B2 6/2003 Erickson et al.
6,615,890 B1 9/2003 Sigafoes
6,634,401 B2 10/2003 Kuhn et al.
6,726,796 B2 4/2004 Wells et al.
6,860,309 B2 3/2005 Hartman et al.
6,868,884 B2 3/2005 Briese
6,984,429 B2 1/2006 Thunhorst et al.
7,014,728 B2 3/2006 Kuhn et al.

(Continued)

FOREIGN PATENT DOCUMENTS

EP 1 552 962 7/2005

(Continued)

*Primary Examiner*—Mark A Osele
*Assistant Examiner*—Christopher C Caillouet

(57) ABSTRACT

Taping heads having an applying arm connected to a buffing arm are described. The taping heads include at least one buffing cam and buffing cam guide are described. Taping heads having two buffing cams and two buffing cam guides are also described.

17 Claims, 10 Drawing Sheets

U.S. PATENT DOCUMENTS

| | | | |
|---|---|---|---|
| 7,063,757 | B2 | 6/2006 | Jacot et al. |
| 7,090,734 | B2 | 8/2006 | Aster et al. |
| 7,093,641 | B2 | 8/2006 | Sharp |
| 2006/0037689 | A1 | 2/2006 | Briese et al. |

FOREIGN PATENT DOCUMENTS

| | | |
|---|---|---|
| GB | 2 325 453 | 11/1998 |
| JP | 07-012366 | 2/1995 |
| JP | 08-174470 | 7/1996 |
| JP | 3078318 | 4/2001 |
| WO | WO 00/15531 | 3/2000 |

* cited by examiner

TAPING HEAD

FIELD

The present disclosure relates to taping heads, including taping heads having at least one buffing cam guide.

SUMMARY

Briefly, in one aspect, the present disclosure provides a taping head comprising a frame, an applying roller, and a buffing roller. The frame comprises an applying cam guide and a first buffing cam guide. The applying roller is connected to an applying arm, which is connected to at least one applying cam located within the applying cam guide. The buffing roller is connected to buffing arm, which is connected to a first buffing cam located in the first buffing cam guide. The applying arm is connected to the buffing arm. In some embodiments, the applying arm is directly attached to the buffing arm at a pivot point allowing the applying arm to rotate relative to the buffing arm.

In some embodiments, the first buffing cam guide is selected such that a path of the buffing roller away from the frame of the taping head comprises a linear portion. In some embodiments, at least 50% of the path of the buffing roller comprises the linear portion. In some embodiments, the linear portion of the path of the buffing roller forms an angle of between 40 and 45 degrees relative to the application plane of the taping head. In some embodiments, the path of the buffing roller further comprises an arcuate portion.

In some embodiments, the buffing arm is connected to a second buffing cam located within a second buffing cam guide. In some embodiments, the first buffing cam guide and the second buffing cam guide are selected such that a path of the buffing roller away from the frame of the taping head comprises a linear portion.

In some embodiments, the applying arm is indirectly connected to the buffing arm by a connecting link. In some embodiments, the connecting link is connected to the buffing arm at a first pivot point, and the connecting link is connected to the applying arm at a second pivot point.

In some embodiments, the first buffing cam guide and the second buffing cam guide are selected such that a path of the buffing roller away from the frame of the taping head comprises a linear portion. In some embodiments, at least 50% of the path of the buffing roller away from the frame of the taping head comprises the linear portion. In some embodiments, the linear portion of the path of the buffing roller forms an angle of between 40 and 45 degrees relative to the applicator plane of the taping head. In some embodiments, the path of the buffing roller further comprises an arcuate portion.

In some embodiments, the first buffing cam guide and the second buffing cam guide are selected such that the buffing roller is set back from the applying roller when they are fully retracted toward the frame.

In another aspect, the present disclosure comprises a taping head comprising a frame, an applying roller, and a buffing roller. The frame comprises an applying cam guide and a first buffing cam guide. The applying roller is connected to an applying arm, which is connected to at least one applying cam located within the applying cam guide. The buffing roller is connected to a buffing arm, which is connected to a first buffing cam located within the first buffing cam guide. The applying arm is directly or indirectly connected to the buffing arm. In some embodiments, the first buffing cam guide is selected such that at least 50% of the path of the buffing roller away from the frame of the taping head comprises a linear portion forming an angle of between 40 and 45 degrees relative to the applicator plane of the taping head.

In some embodiments, the buffing arm is further connected to a second buffing cam located within a second buffing cam guide. In some embodiments, the first buffing cam guide and the second buffing cam guide are selected such that at least 50% of the path of the buffing roller away from the frame of the taping head comprises the linear portion. In some embodiments, the linear portion forms an angle of between 40 and 45 degrees relative to the applicator plane of the taping head.

In some embodiments, the applying arm is indirectly connected to the buffing arm by a connecting link, wherein the connecting link is connected to the buffing arm at a first pivot point, and the connecting link is connected to the applying arm at a second pivot point.

In some embodiments, the first buffing cam guide and the second buffing cam guide are further selected such that the buffing roller is set-back from the applying roller when they are fully retracted toward the frame.

In some embodiments, the first buffing cam guide and the second buffing cam guide are further selected such that the path of the buffing roller comprises the linear portion and an arcuate portion, wherein at least 80% of the path of the buffing roller comprises the linear portion, and wherein the linear portion forms an angle of between 41 and 43 degrees relative to the applicator plane of the taping head.

The above summary of the present disclosure is not intended to describe each embodiment of the present invention. The details of one or more embodiments of the invention are also set forth in the description below. Other features, objects, and advantages of the invention will be apparent from the description and from the claims.

DETAILED DESCRIPTION

Figure 1A:
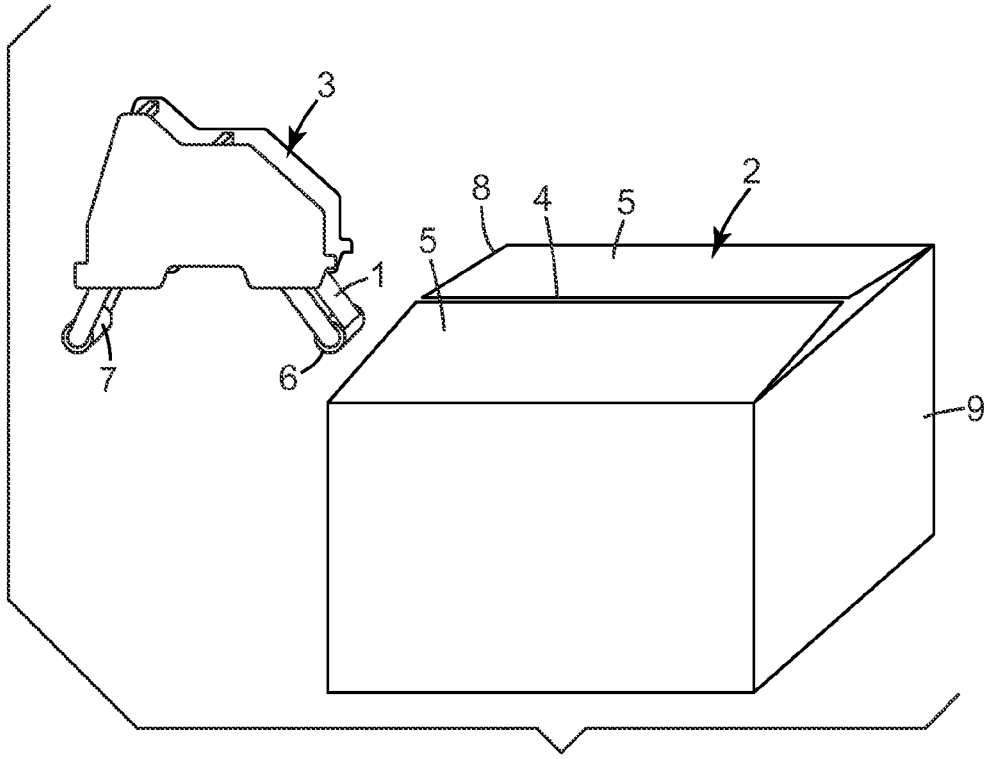
FIGS. 1*a*-1*c* illustrate the use of a taping head to apply tape to seal a container.

Containers, e.g., cases, cartons, and boxes, may be sealed by applying strips of tape along seams to seal adjacent flaps of an opening. Often, this procedure is automated and the tape is applied by one or more taping heads as the container is conveyed past them. For example, referring to FIGS. 1*a*-1*c*, tape 1, e.g., a pressure sensitive adhesive box sealing tape, may be applied in a packaging line where container 2 is moved past taping head 3 by, e.g., a conveyor belt (not shown). Taping head 3 applies the desired length of tape along seam 4 to seal adjacent flaps 5. Typically, taping head 3 includes upstream applying roller 6 and down stream buffing roller 7.

Figure 1B:
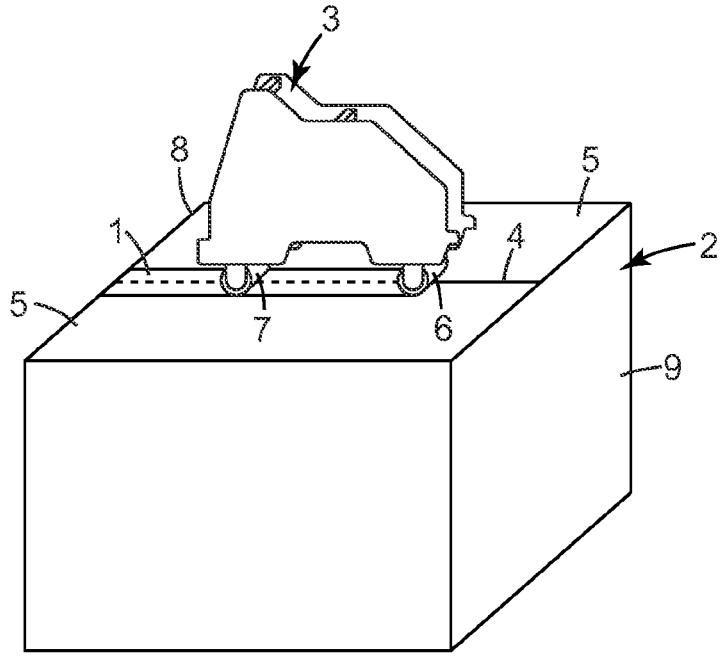
Figure 1C:
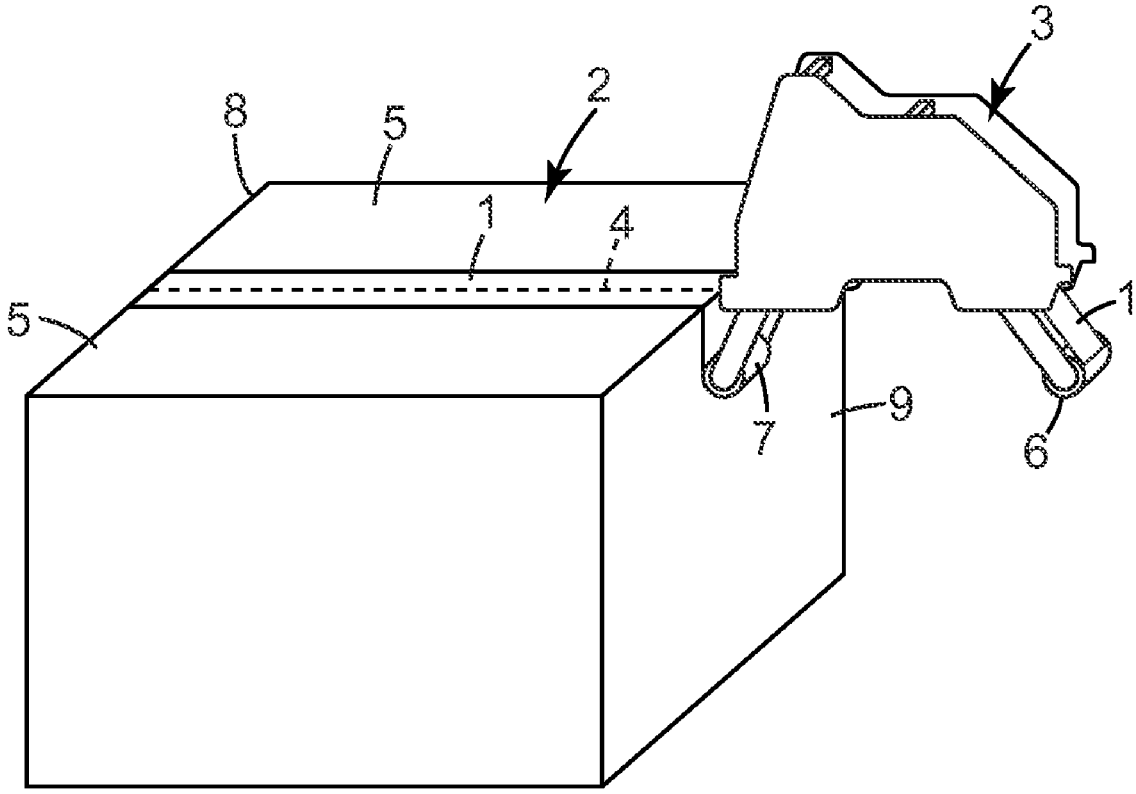

Referring to FIG. 1*a*, as container 2 approaches taping head 3, the container first engages applying roller 6. As the container continues to move relative to the taping head, tape is first applied to leading face 8 of container 2, and applying roller 6 is pushed into the taping head frame by the motion of the container. Referring to FIG. 1*b*, as the container is conveyed past the taping head, tape 1 is applied along the length of seam 4 sealing flaps 5 together. Finally, referring to FIG. 1*c*, as the container reaches the end of the taping head, the tape is cut, and buffing roller 7 descends from the taping head applying tape to trailing face 9 of container 2, completing the sealing operation.

Figure 2A:
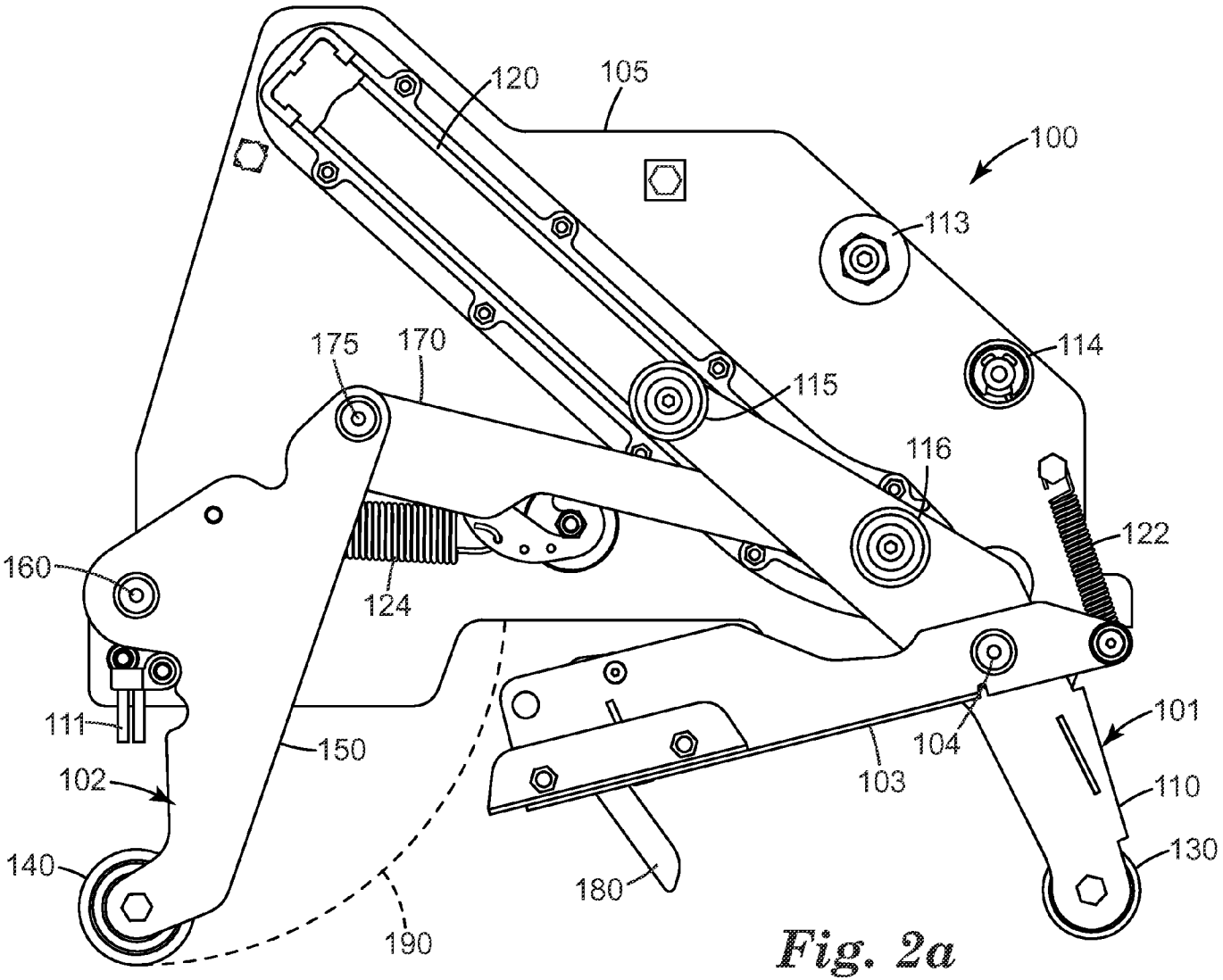
Fig. 2a PRIOR ART
FIG. 2*a* illustrates a side view of a prior art taping head in its extended position.
Figure 2B:
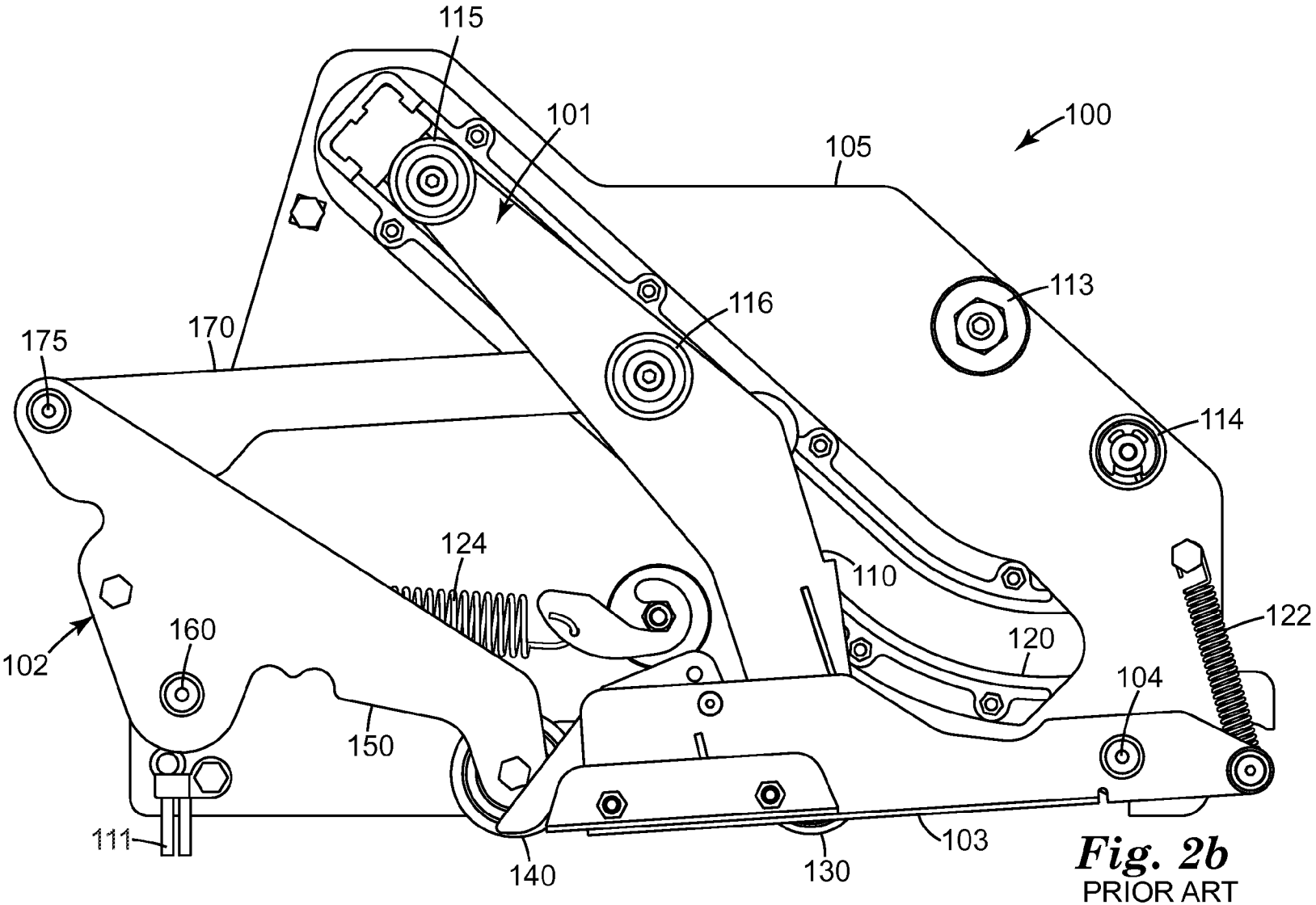
Fig. 2b PRIOR ART
FIG. 2*b* illustrates a side view of the prior art taping head of FIG. 2*a* in its applying position.

One side of a prior art taping head 100 is shown in FIGS. 2*a* and 2*b*. Generally, a taping head comprises two sides, which are mirror images of each other and that are connected by a frame. Also, side plates may be attached to encase the taping head. Referring to FIG. 2*a*, taping head 100 is shown in an extended position with applying assembly 101 and buffing assembly 102 extending below and connected to frame 105. Bracket spring 122 holds cutter bracket 103, which is connected to frame 105 at pivot point 104. Cutter bracket 103 includes blade guard 180, which protects the blade (not shown) that is used to sever the tape at the desired location.

Applying assembly 101 comprises applying arm 110 connected to applying roller 130. Applying assembly 101 further comprises applying cam rollers 115 and 116, which link applying arm 110 to frame 105. As applying arm 110 extends and retracts relative to frame 105, the path of applying roller 130 is controlled by the motion of cam rollers 115 and 116 along applying cam guide 120.

Applying arm 110 is coupled to buffing arm 150 via connecting link 170. Connecting link 170 is mechanically coupled to applying arm 110 at applying cam 116. The mechanical connection is such that connecting link 170 and applying arm 110 are free to rotate relative to each other about this connection as the applying arm is guided along its path as applying cams 115 and 116 move along applying cam guide 120.

Buffing assembly 102 comprises buffing arm 150 connected to buffing roller 140. Connecting link 170 is mechanically coupled to buffing arm 150 at connecting point 175. Connecting link 170 and buffing arm 150 are free to rotate relative to each other about connecting point 175, as buffing arm 150 also rotates about pivot point 160, where the buffing arm is connected to frame 105. Buffing assembly 102 is held in its extended position by buffing spring 124.

Generally, taping heads also include additional elements that provide structural integrity and/or additional features. For example, in some embodiments, the taping head may include tape tension roller 113 and tape wrap roller 114, which may provide a desired tape path through the taping head.

Referring to FIG. 2*b*, when a container (not shown) engages applying roller 130, the motion of the container pushes applying arm 110 toward and into frame 105, with its path determined by the movement of applying cams 115 and 116 along applying cam guide 120. The container also forces cutter bracket 103 toward frame 105, stretching bracket spring 122.

Because applying arm 110 is linked to buffing arm 150 via connecting link 170, the motion of the applying arm results in the retraction of buffing roller 140 toward frame 105 as buffing arm 150 is rotated about pivot point 160. As the buffing arm rotates raising the buffing roller, buffing spring 124 is stretched creating a counter force tending to extend the buffing arm and the buffing roller away from the frame. This counter force is transmitted through connecting link 170 to applying arm 110, tending to force applying roller 130 away from frame 105 and pressing the tape against the seam to seal the container. Optional brush 111 also aides in pressing the tape against the seam.

After the container passes beneath the applying roller, the applying arm is no longer held in its retracted position; however, the motion of the applying arm relative to the frame is linked to the motion of the buffing arm via connecting link 170. As the container continues to move under the buffing roller, the buffing roller applies pressure to the tape, as the buffing roller is urged toward the container by the buffing spring.

Referring again to FIG. 2*a*, after the container passes beneath cutter bracket 103, it pivots away from frame 105 as bracket spring 122 relaxes. As cutter bracket 103 pivots away from the frame, the tape is cut a defined location to produce a desired trailing tape leg length. In some embodiments, the tape is cut by a blade (not shown), which may be protected by, e.g., blade guard 180. As used herein, the term "tape leg" refers to that portion of the tape extending along either the leading face (the leading tape leg) or the trailing face (the trailing tape leg) of the container.

Finally, after the container has passed beneath buffing roller 140, the relaxation of buffing spring 124 returns applying arm 110 and buffing arm 150 to their extended positions. The motion of applying arm 110 is once again controlled by the motion of applying cams 115 and 116 along applying cam guide 120. This motion is transmitted to buffing arm 150 via connecting link 170, causing the rotation of buffing arm 150 about pivot point 160. As a result, buffing roller 140 follows arcuate path 190, applying tape to the trailing edge of the container to complete the seal.

When using such a taping head, the ability to tailor the path of the buffing roller to meet various design criteria is limited. For example, the shape of arcuate path 190 is an arc of fixed radius determined by the distance between pivot point 160 and buffing roller 140, while the speed at which the buffing roller traverses arcuate path 190 depends on, e.g., the shape of applying cam guide 120, the length of connecting link 170, the location of connecting point 175 relative to pivot point 160 and buffing roller 140, and the force of buffing spring 124.

The motion of the buffing roller along the arcuate path is adequate for some applications, e.g., when containers are moving past the taping head at speeds of less than about 25 meters/minute (80 feet per minute). In such applications, the buffing roller provides adequate adhesive buff down along the entire length of the trailing tape leg.

However, at higher line speeds, e.g., greater than about 25 meters/minute, the buffing roller may not traverse the arcuate path quickly enough to keep up with the motion of the container, and the buffing roller may not contact the top portion of the trailing tape leg near the corner between, e.g., the top and the trailing face of the container. Once the buffing roller catches up with the container, it only buffs the tape against the trailing face of the container partially down the trailing tape leg, i.e., some distance from the corner of the container.

The motion of the buffing roller along the initial portion of the arcuate path is primarily perpendicular to the motion of the container to be sealed. Thus, depending on the speed of the container past the taping head, the distance between the container and the buffing roller during this portion of the arcuate path may increase. As the buffing roller begins to travel more in a diagonal direction towards the container, it catches up to and makes contact with the container. Then, the buffing roller will finish its movement against the container buffing down the trailing tape leg.

As the operating speed increases, the ability of the buffing roller to catch up to the container decreases, resulting in the roller hitting the container farther down the trailing tape leg, away from the corner. With less of the tape leg properly buffed against the trailing face of the container, the quality of the tape seal may decrease and result in seals that can fail under load. Ultimately, at high enough container speeds, the buffing roller will not catch up to the container before buffing roller reaches the end of its motion, and the trailing tape leg will not be buffed down at all.

Figure 3A:
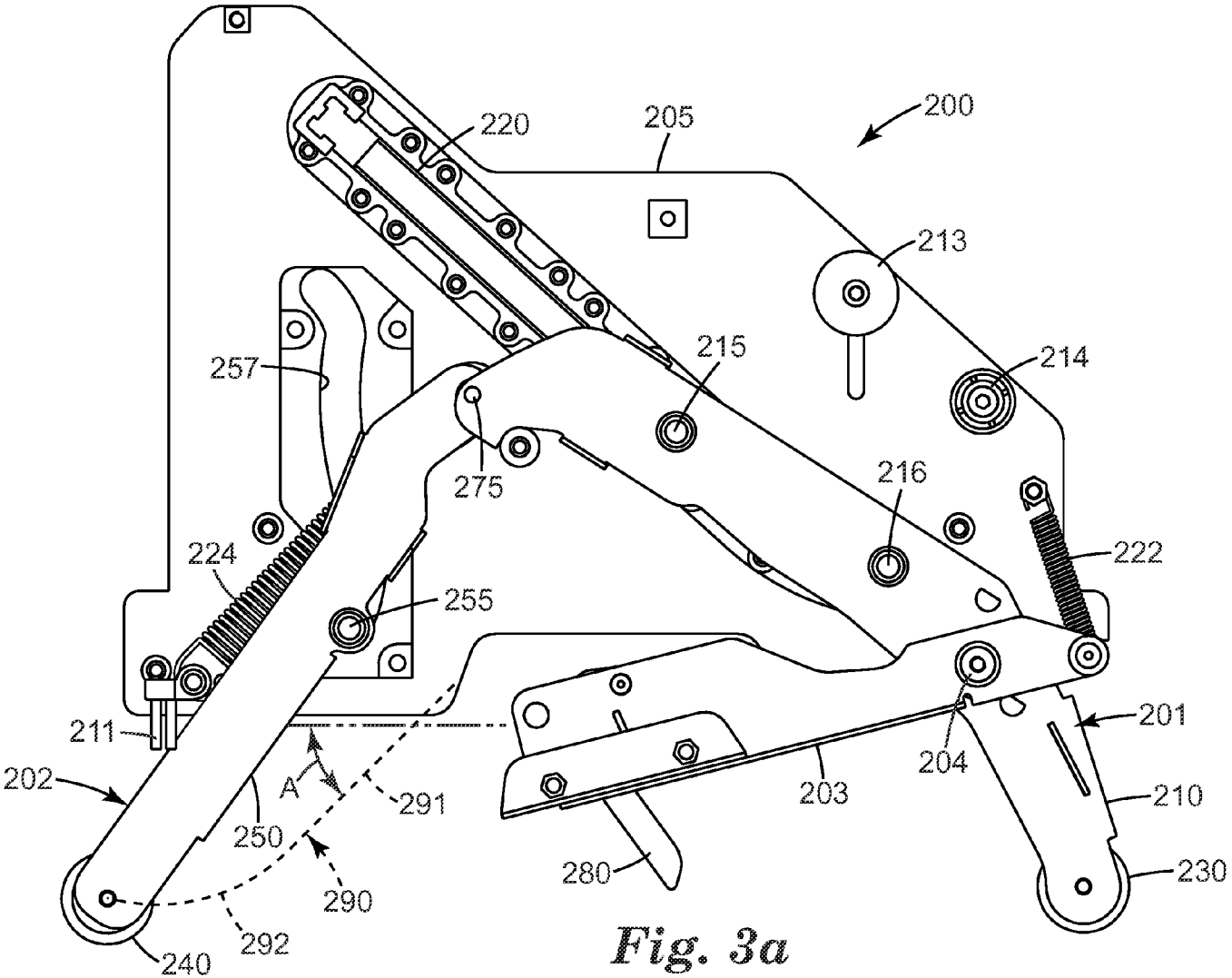
FIG. 3*a* illustrates a side view of an exemplary taping head having a single buffing cam guide, according to some embodiments of the present disclosure.
Figure 3B:
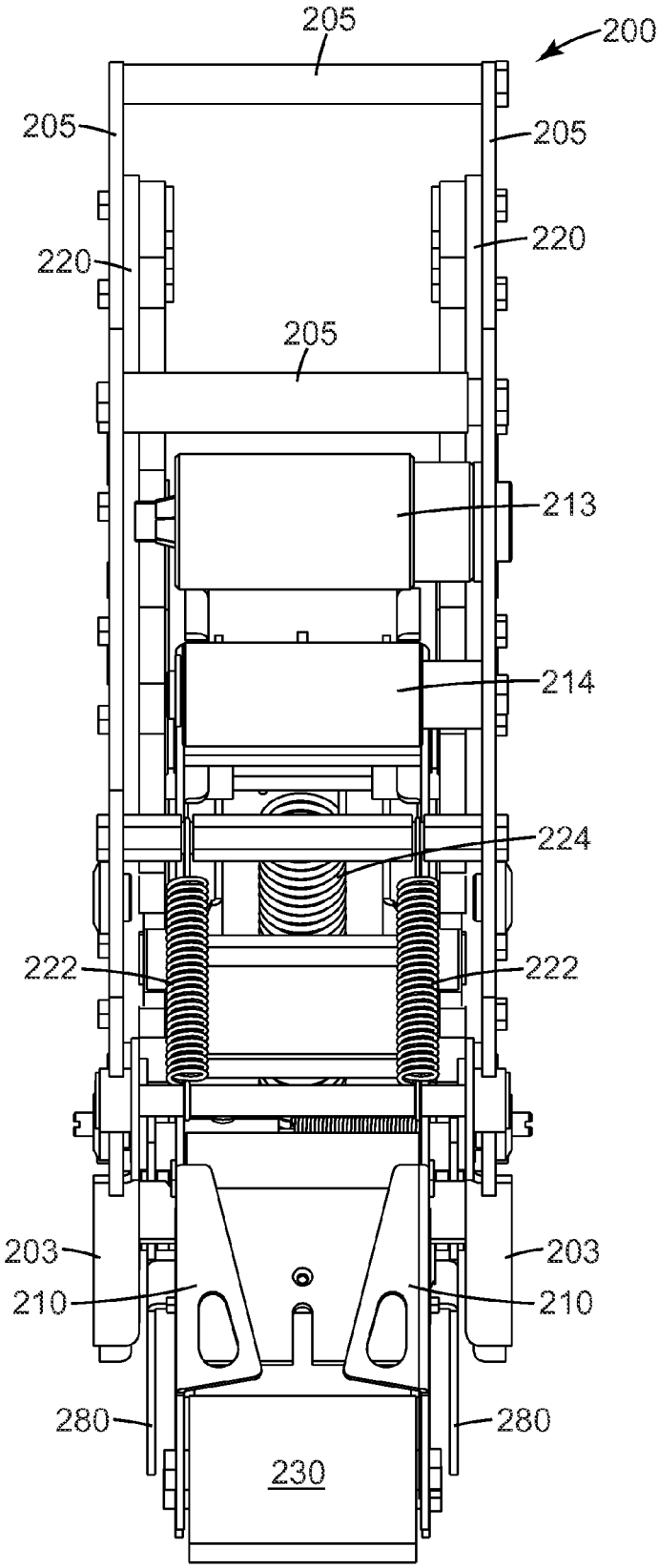
FIG. 3*b* illustrates a front view of the exemplary taping head of FIG. 3*a*.
Figure 3C:
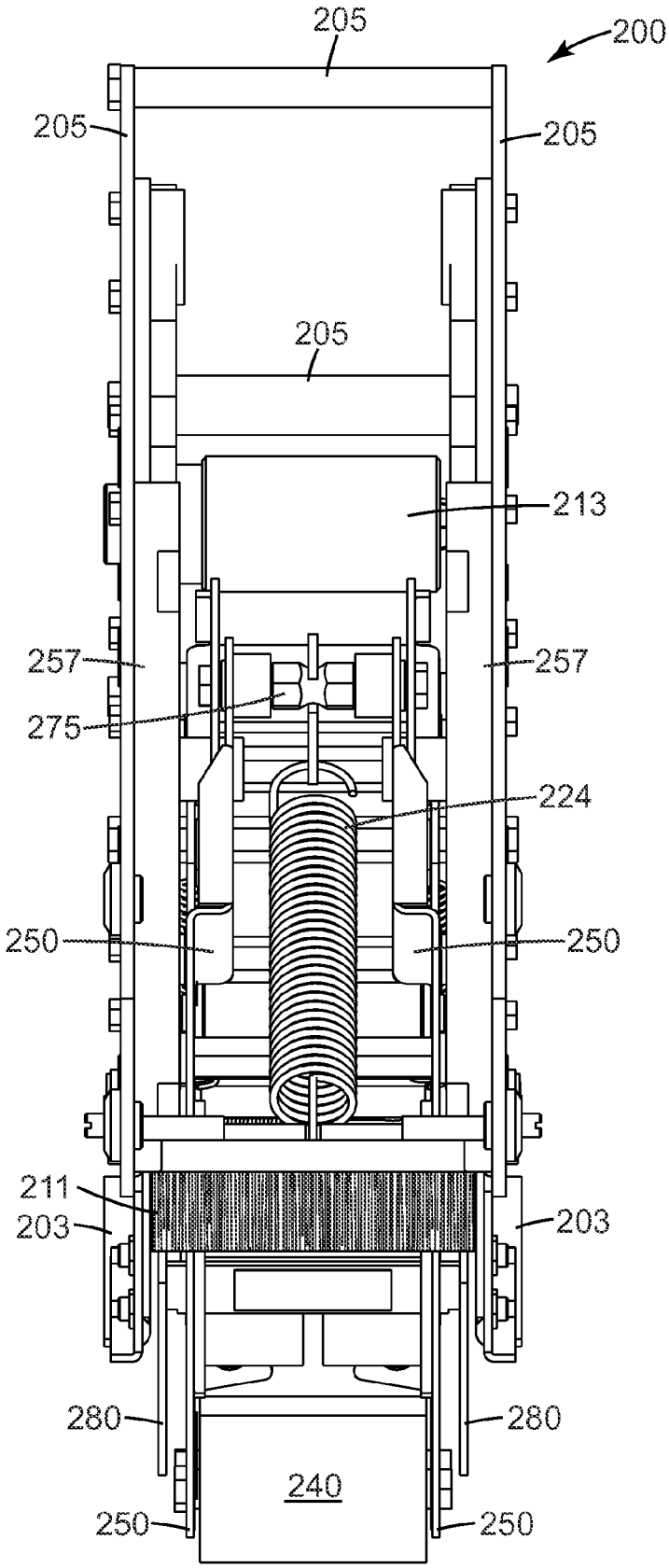
FIG. 3*c* illustrates a rear view of the exemplary taping head of FIG. 3*a*.

A side view of a taping head comprising a single-guide buffing assembly according to some embodiments of the present disclosure is shown in FIG. 3*a*. Taping head 200 comprises applying assembly 201 and a buffing assembly 202 connected to frame 205. Front and rear views of this taping head are shown in FIGS. 3*b* and 3*c*, respectively.

Referring to FIG. 3*a*, applying assembly 201 includes applying arm 210, applying roller 230, and applying cams 215 and 216. Base 203 is connected to frame 205 at pivot point 204 and is held by bracket spring 222. Both applying arm 210 and buffing arm 250 are shown extended from frame 205.

Buffing assembly 202 includes buffing arm 250, buffing roller 240, and buffing cam 255. Buffing arm 250 is connected to applying arm 210 at pivot point 275 such that buffing arm 250 and applying arm 210 are free to rotate relative to each other about the pivot point.

As shown in FIG. 3*a*, as applying roller 230 extends and retracts relative to frame 205, its motion is controlled by applying arm 210 as applying cams 215 and 216 travel along applying cam guide 220. The motion of applying roller 230 and the associated motion of applying arm 210 is linked to the motion of buffing arm 250. Thus, as a container passes by taping head 200, applying arm 210 is forced toward and into frame 205. The motion is transmitted to buffing arm 250, which is then also driven toward frame 205, stretching buffing spring 224.

As the container passes beneath applying roller 230, buffing spring 224 tends to force applying arm 210 away from frame 205, thereby applying a force tending to press tape against the container, sealing the seam. Optional brush 211 also assists in pressing the tape against the container. After the container has passed beneath buffing roller 240, buffing spring 224 relaxes, forcing buffing arm 250 and applying arm 210 away from frame 205.

Referring to FIGS. 3*b* and 3*c*, additional details of taping head 200 are shown. Frame 205 extends around the perimeter of taping head 200 and includes various elements linking the two sides of the taping head together. The first side of the taping head was described with reference to FIG. 3*a*, above. The second side is generally a mirror image of the first side.

Referring to FIG. 3*b*, a front view of taping head 200 includes optional tape tension roller 213 and tape wrap roller 214, which are used to guide tape along a desired path through the taping head. Applying roller 230 is connected to applying arms 210. The applying cams (not shown) guide the motion of the applying arm as the cams move along the applying cam guides 220. Bracket springs 222 hold cutter bracket 203 in place relative to frame 205. Blade guard 280 extends from cutter bracket 203 towards applying roller 230. Buffing spring 224 is also shown.

Referring to FIG. 3*c*, a rear view of taping head 200 including frame 205, is shown. This view of taping head 200 includes optional tape tension roller 213, which is used to guide tape along a desired path through the taping head. Buffing roller 240 is connected to buffing arms 250. The buffing cam (not shown) guides the motion of the buffing arm as the cam move along the buffing cam guides 257. Buffing spring 224 is connected to buffing arms 250 and to frame 205 at pivot point 275. Blade guard 280 extends from cutter bracket 203. Optional brush 211, which may be used to further force tape against a container during application, is also shown.

Referring again to FIG. 3*a*, the motion of buffing arm 250, and thus the path of buffing roller 240, is controlled in part by the motion of buffing cam 255 along buffing cam guide 257. The buffing cam guide may be selected to provide additional control over the path of the buffing roller as it extends from the frame and may be more complex than the simple arcuate path of the buffing roller of the prior art device. For example, as shown in FIG. 3*a*, in some embodiments, buffing roller path 290 comprises initial linear portion 291 and terminal arcuate portion 292.

Beginning with the desired buffing roller path, the shape of the buffing cam guide may be determined. Additional factors affecting the final buffing cam guide shape include the path of the applying cam guide, and the lengths and orientations of the various connected elements, i.e., the applying arm and the buffing arm, and the location of pivot point connecting them. In addition, spatial constraints within the taping head may affect the final selection of the buffing cam guide path.

Generally, the buffing cam guide can be designed to produce a linear motion for the buffing roller as the applying cams moves along the applying cam guides and the buffing cam moves along the buffing cam guide. As discussed previously, at speeds over 25 meters per minute (80 feet per minute), a buffing roller following a purely arcuate path may not be able to keep the buffing roller in contact with the container during the initial stage of its movement, i.e., the portion of buffing roller path that is primarily perpendicular to the motion of the container. The linear buffing movement provided by taping head 200 allows for higher operating speeds by minimizing or eliminating this initial perpendicular motion of the buffing roller. Specifically, in some embodiments, the motion of the buffing roller starts directly with a linear diagonal movement towards the container. In some embodiments, this linear motion can be maintained through the end of the buffing roller's movement to the bottom of the trailing tape leg.

In some embodiments, the path of the buffing roller will include a linear portion for a portion of its path, followed by an arcuate portion. For example, the linear portion may extend over the 50%, in some embodiments, the 60%, 70%, or even 80% of the buffing roller path.

Generally, this linear portion will be diagonal, causing the buffing roller to keep up with or move toward the container as it passes by the taping head. In some embodiments, the angle, A, of the linear portion relative to the application plane of the taping head will be no greater than 50 degrees, and in some embodiments, no greater the 45 degrees, e.g., 41 to 43 degrees, e.g., 42 degrees. As used herein, the "application plane" of the taping head is defined by the axis of the application roller and the direction of intended motion of the container past the taping head, which is generally perpendicular to the axis of the application roller. For example, if the taping head was positioned above the container and parallel to the ground, the application plane would also be parallel to the ground. However, if the containers are traveling at some angle, B, relative to the ground (e.g., as the travel down a sloped conveyer, the taping head may also be oriented at angle B so that it is parallel to the top of the container. In such a case, the application plane of the taping head would from an angle B relative to the ground as well.

In some embodiments, the angle and relative length of the linear portion and the path of the remaining arcuate portion are selected to correspond to the movement of the applying roller as it is guided by the applying cams traversing the applying cam guide. In some embodiments, it may be desirable to maintain the maximum velocity of the buffing roller towards the container. In some embodiments, the movements of the applying and buffing rollers are designed to fully apply/buff tape legs of the desired length, e.g., typically 7 cm (2.75 inches).

In some embodiments, taping heads are used in pairs in a container sealing machines. Generally, one taping head is mounted above a container for a top seal and one taping head is mounted below the container for a bottom seal. Generally, the minimum container height able to run through a case sealer is determined by how close together the upper and lower taping heads can operate without interfering with each other. Because of this constraint, taping heads may be designed such that the applying and buffing rollers can move out to, but not past the maximum desired tape leg length (e.g., 7 cm). Generally, the greater the maximum desired tape leg length, the further apart the taping heads must be spaced, and the greater the minimum container size that can be sealed.

The present inventors have determined that, if the buffing roller moves along certain paths (e.g., a purely linear path), or if the linear path forms a large angle, e.g., 60° or more, relative to the tape application plane; the path length of the buffing roller would be shorter than the path length of the applying roller. In such a situation, the buffing roller would tend to reach its maximum extended position before the applying roller reached the end of its extension if both rollers traveled at the same speed. However, the motion of the buffing roller is linked to the motion of the applying roller; thus, one roller cannot move without the other. Therefore, if the buffing roller path is shorter than the applying roller path, the only way that both rollers could reach the end of their travel at the same time would be for the buffing roller to slow down in relation to the applying roller. This is generally not desirable, because any slowing of the buffing roller could allow the container to move away from the buffing roller before it reaches the end of the trailing tape leg, resulting in a poor tape seal. By mirroring the path of the applying roller, the buffing roller can maintain its desired velocity throughout its entire path.

Generally, case sealing equipment (e.g., taping heads) are selected to seal containers of all fill levels (i.e., completely filled and partially filled containers). In addition, the cam path of the buffing guide is selected so that the cam roller moves smoothly throughout the entire path. Without a smooth path, the cam roller could stick on any sharp corners of the cam path, slowing down the motion of the mechanism.

With the available degrees of freedom from directly linking the buffing arm to the applying arm and controlling the motion of the buffing arm with a single cam path, it may be difficult to keep the buffing path smooth without forcing the buffing roller out of the taping head at a faster rate than the apply roller. In some embodiments, this may be a desirable result as it may allow the taping head to operate at higher line speeds. However, problems can arise when an under packed container (or a filled container holding soft, compressible goods) is moved past the taping head.

Generally, containers that are under packed are unsupported in the middle between the leading and trailing faces (i.e., walls) of the container. When this happens, the force exerted by the buffing spring of the taping head can push the applying roller and/or the buffing roller in on the flaps of the container, dipping the rollers inside the top face of the container.

Generally, if an under filled container traveled past taping head 200, the applying roller would first be driven up to its fully retracted position, moving the buffing roller up to its fully retracted position, as is typically desired. However, in some embodiments, when the applying roller reaches the unsupported middle of the container, it might be forced down away from the taping head frame before the leading face of the container had passed underneath the buffing roller. Absent the support of the container, the buffing roller may extend down in front of the leading face of the container, which may cause a jam, leading to packaging line down time and, potentially, damage to the taping head and/or the container and its contents.

Figure 4A:
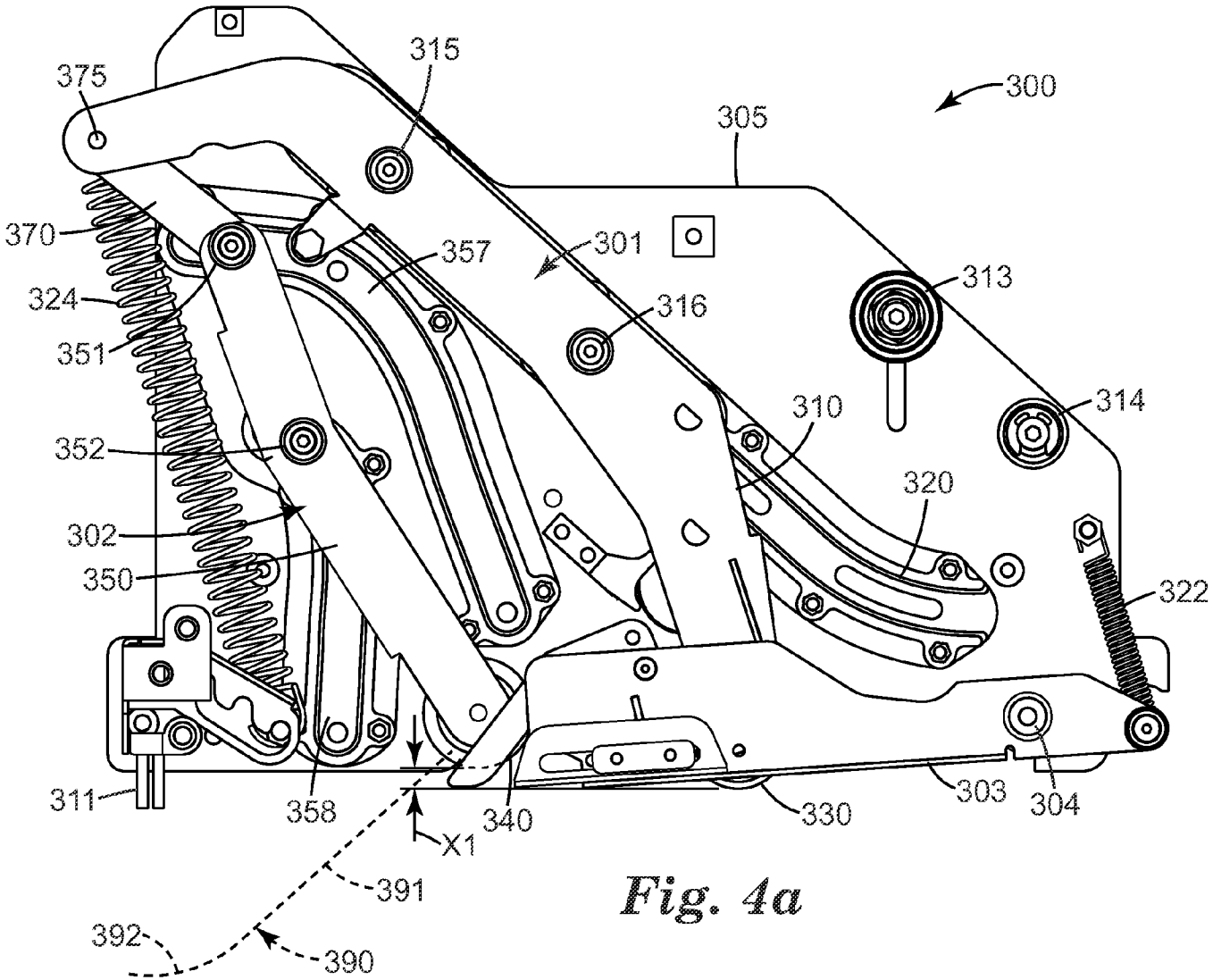
FIG. 4*a* illustrates a side view an exemplary taping head having two buffing cam guides, according to some embodiments of the present disclosure in its applying position.
Figure 4B:
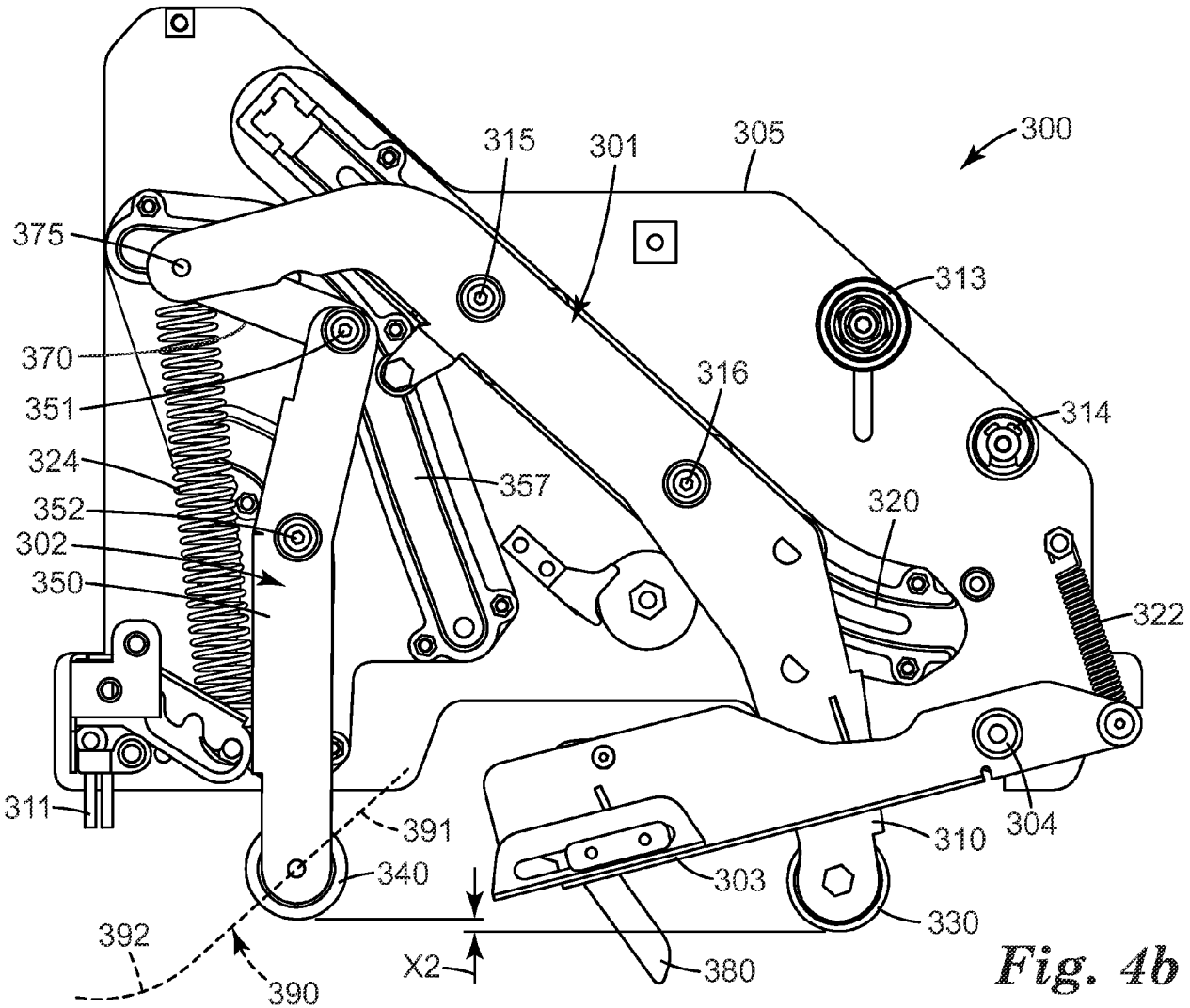
FIG. 4*b* illustrates a side view of the taping head of FIG. 4*a* as the buffing arm and applying arm travel toward their extended positions.
Figure 4C:
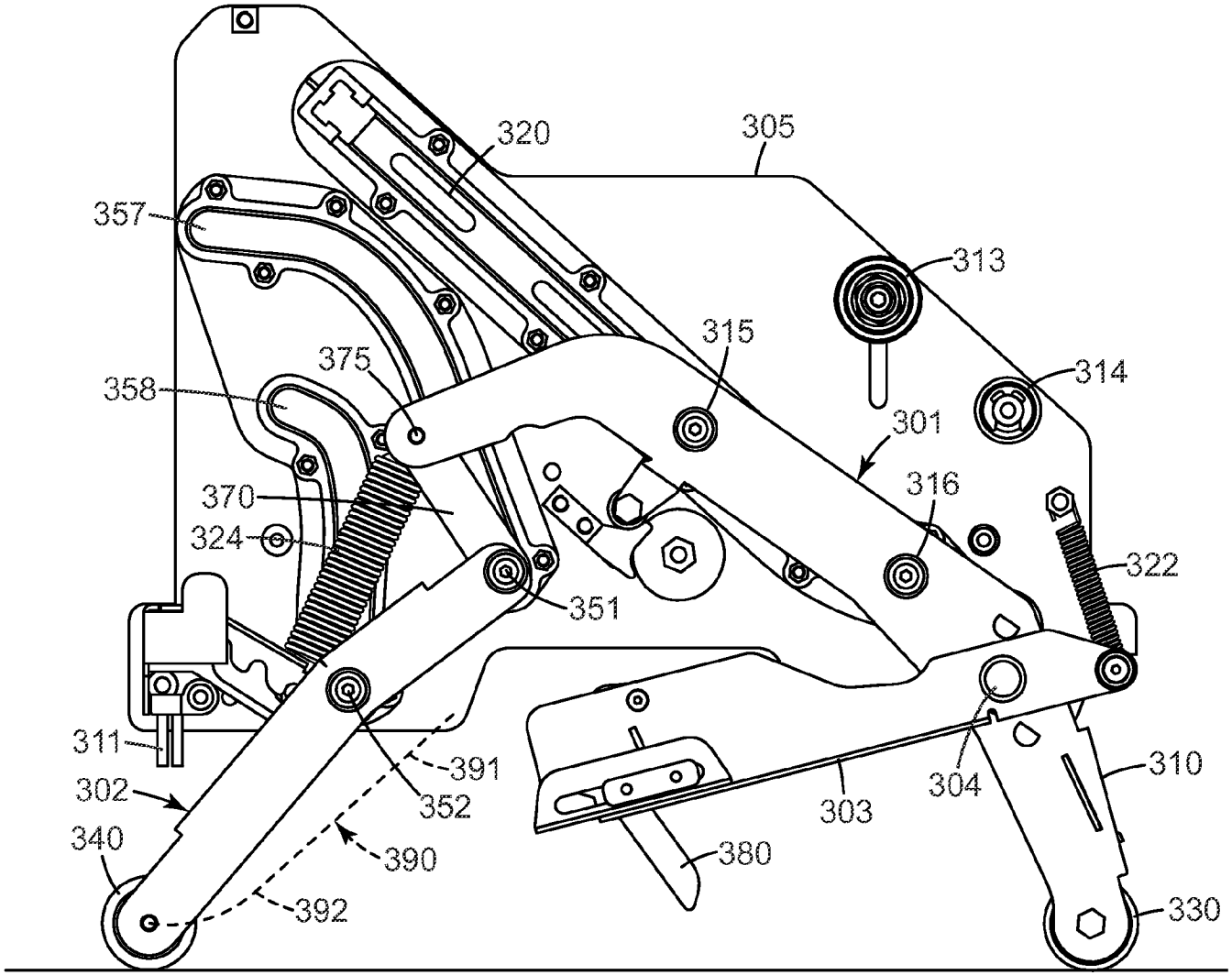
FIG. 4*c* illustrates a side view of the taping head of FIG. 4*a* in its extended position.

One side of a taping head comprising a dual-guide buffing assembly according to some embodiments of the present disclosure is shown in FIGS. 4*a*-4*c*. Taping head 300 comprises applying assembly 301 and buffing assembly 302 connected to frame 305.

Applying assembly 301 comprises applying arm 310, and applying cams 315 and 316. Applying cams 315 and 316 travel along applying cam guide 320, controlling the motion of the applying arm and applying roller 330.

Buffing assembly 302 comprises buffing arm 350 and buffing roller 340. Buffing assembly 302 also includes first buffing cam 351, which travels along first buffing cam guide 357, and second buffing cam 352, which travels along second buffing cam guide 358.

Buffing arm 350 is connected to applying arm 310 via connecting link 370. Connecting link 370 is connected to buffing arm 350 at first buffing cam 351 such that the connecting link and the buffing arm are free to rotate relative to each other about this point. Similarly, connecting link 370 is connected to applying arm 310 at pivot point 375 such that the connecting link and the applying arm are free to rotate relative to each other about this point.

FIG. 4*a* illustrates one side of dual guide taping head 300 in its fully retracted position as it would appear when a tape is being applied to a container (not shown). Buffing spring 324 is extended, exerting a force on both buffing arm 350 and applying arm 310 tending to force them away from frame 305. Bracket spring 322 is also extended as cutter bracket 303 is forced up toward frame 305. As shown, exemplary taping head 300 includes optional brush 311, tape tension roller 313, and tape wrap roller 314.

As shown in FIGS. 4*b* and 4*c*, after a container passes beneath buffing roller 340, buffing spring 324 relaxes. As buffing spring 324 relaxes, applying roller 330 is forced away from frame 305 and its path is controlled by applying arm 310 as applying cams 315 and 316 travel along applying cam guide 320. As buffing spring 324 relaxes, buffing arm 350 and buffing roller 340 are also forced away from frame 305. The motion of applying arm 310 and buffing arm 350 are linked as these arms are connected via connecting link 370.

The motion of buffing arm 350, and thus the motion of buffing roller 340, is controlled in part by the motion of both first buffing cam 351 along first buffing cam guide 357 and second buffing cam 352 along second buffing cam guide 358.

The buffing cam guides may be selected to provide a desired path for buffing roller 340. As shown in FIGS. 4*b* and 4*c*, in some embodiments, buffing roller path 390 comprises initial linear path 391 as the buffing roller begins to move away from frame 305. In some embodiments, buffing roller path 390 comprises initial linear path 391 and subsequent arcuate path 392.

As the buffing arm and applying arm extend from the frame, bracket spring 322 relaxes and cutter bracket 303 swings away from frame 305 as it rotates about pivot point 304. As the cutter bracket moves, a blade (not shown) and optional blade guard 380 extend to cut the tape to provide the trailing tape leg.

Replacing the direct pivot connection between the buffing arm and the applying arm of taping head 200, with connecting link 370 in taping head 300, provides independent freedom of rotation relative to both the applying arm and the buffing arm. This, along with the addition of a second buffing cam guide path, provides for more freedom in designing the desired path for the buffing roller. With this freedom, the paths of the buffing cam guides and the locations of the buffing cams can be designed so that the buffing roller stays even with or set-back from the applying roller all the way through its travel to the end of the desired tape length, reducing the risk of a container jam caused by the buffing roller hanging below the applying roller.

Referring to FIG. 4*a*, in some embodiments, the buffing cams and cam paths are designed so that buffing roller 340 is set-back some desired distance, X1, (e.g., 5 to 7 mm (0.2 to 0.3 inches) relative to applying roller 310 when both rollers are in their fully-retracted positions. This allows the applying roller to dip some distance (e.g., X1) into an under filled container and still ensure that the buffing roller will not extend down in front of the leading edge of the container. As the distance the applying roller dips into the unfilled container increases, the amount of set-back may need to be increased as well.

As the container moves past the taping head, the leading edge of the container will drive the mechanism up into the taping head with the buffing roller set-back above the applying roller. While both rollers are on top of the container, the applying roller is pressing tape against the container. In some embodiments, e.g., if there is sufficient dipping of the applying roller into an under filled container, the buffing roller may also be in contact with the tape. When the trailing edge of the container moves past the applying roller, the applying roller will move away frame the frame under the force of the applying spring until the buffing roller begins pressing the tape against the container. Finally, as the trailing edge of the container moves past the buffing roller, the buffing roller will follow its desired path (e.g., it may move downward in a diagonal linear motion) to maintain contact with the trailing edge of the container.

In some embodiments, in order to include the desired set-back of the buffing roller relative to the applying roller, yet meet the mechanical constraint that both the buffing roller and the applying roller have to reach their final extended positions at same time, the buffing roller may be guided down at a faster pace than the applying roller for a portion of their paths.

For example, in some embodiments, in order to account for the additional path length corresponding to the set-back distance, the speed of the buffing roller may be greater than the speed of the applying roller over at least the initial portion of their paths. Referring to FIG. 4*b*, as buffing roller 340 and applying roller 330 extend from the frame, the set-back between the rollers, X2, decreases (i.e., X2 is less than the initial set-back, X1). Finally, as shown in FIG. 4*c*, during the final portion of their paths, buffing roller 340 is no longer set back from applying roller 330 so that both rollers reach the end of their travel at the same time. In some embodiments, the final portions of their paths may be selected so that they travel at the same speed to the end of their travel.

Various modifications and alterations of this invention will become apparent to those skilled in the art without departing from the scope and spirit of this invention.

What is claimed is:

1. A taping head comprising: a frame comprising an applying cam guide and a first buffing cam guide; an applying roller connected to an applying arm, wherein the applying arm is connected to at least one applying cam located within the applying cam guide; and a buffing roller connected to a buffing arm, wherein the buffing arm is connected to a first buffing cam located in the first buffing cam guide; wherein the applying arm is connected to the buffing arm; wherein the first buffing cam guide is selected such that a path of the buffing roller away from the frame of the taping head comprises a linear portion; wherein at least 50% of the path of the buffing roller comprises a linear portion; wherein the path of the buffing roller further comprises an arcuate portion.

2. The tapping head of claim 1, wherein the liner portion of the path of the buffing roller forms an angle of between 40 and 45 degrees relative to an application plane of the taping head.

3. The tapping head of claim 1, wherein the applying arm is directly attached to the buffing arm at a pivot point allowing the applying arm to rotate relative to the buffing arm.

4. The tapping head of claim 1, wherein the buffing arm is connected to a second buffing cam located within a second buffing cam guide.

5. The tapping head of claim 4, wherein the first buffing cam guide and the second buffing cam guide are selected such that a path of the buffing roller away from the frame of the tapping head comprises a linear portion.

6. The tapping head of claim 5, wherein at least 50% of the path of the buffing roller comprises a linear portion.

7. The tapping head of claim 6, wherein the liner portion of the path of the buffing roller forms an angle of between 40 and 45 degrees relative to an application plane of the taping head.

8. The taping head of claim 4, wherein the applying arm is indirectly connected to the buffing arm by a connecting link.

9. The taping head of claim 8, wherein the connecting link is connected to the buffing arm at a first pivot point, and the connecting link is connected to the applying arm at a second pivot point.

10. The taping head of claim 9, wherein the first buffing cam guide and the second buffing cam guide are selected such that a path of the buffing roller away from the frame of the taping head comprises a linear portion.

11. The taping head of claim 10, wherein at least 50% of the path of the buffing roller away from the frame of the taping head comprises the linear portion.

12. The taping head of claim 11, wherein the linear portion of the buffing roller forms an angle of between 40 and 45 degrees relative to an application plane of the taping head.

13. The taping of claim 4, wherein the first buffing cam guide the second buffing cam guide is selected such that the buffing roller is set-back from the applying roller when they are fully retracted toward the frame.

14. A taping head comprising: a frame comprising of an applying cam guide and a first buffing cam guide; an applying roller connected to an applying arm, wherein the applying arm, wherein the applying arm is connected to at least one applying cam located within the applying cam guide; and a buffing roller to a buffing arm, wherein the buffing arm is connected to a first buffing cam located within the first buffing cam guide, wherein the applying arm is connected to the buffing arm, and wherein the first buffing cam guide is selected such that at least 50% of the path of the buffing roller away from the frame of the taping head comprises a linear portion forming an angle of between 40 and 45 degrees relative to an application plane of the taping head; wherein the applying arm is indirectly connnected to the buffing arm by a connecting link, wherein the connecting link is connected to the buffing arm at a first pivot point, and the connecting link is connected to the applying arm at a second pivot point.

15. The taping head of claim 14, wherein the buffing arm is further connected to a second buffing cam located within a second buffing cam guide, and the first buffing cam guide and the second buffing cam guide are selected such that at least 50% of the path of the buffing roller away from the frame of the taping head comprises the linear portion forming an angle of between 40 and 45 degrees relative to an application plane of the taping head.

16. The taping head of claim 14, wherein the first buffing cam guide and the second buffing cam guide are further selected such that the buffing roller is set-back from the applying roller when they are fully retracted toward the frame.

17. The taping head of claim 16, wherein the first buffing cam guide and the second buffing cam guide are further selected such that the path of the buffing roller comprises the linear portion and an arcuate portion, wherein at least 80% of the path of the buffing roller comprises the linear portion, and wherein the linear portion forms an angle of between 41 and 43 degrees relative to the application plane of the taping head.

* * * * *

UNITED STATES PATENT AND TRADEMARK OFFICE

CERTIFICATE OF CORRECTION

PATENT NO. : 7,836,932 B2
APPLICATION NO. : 11/855452
DATED : November 23, 2010
INVENTOR(S) : Steven G Lucht It is certified that error appears in the above-identified patent and that said Letters Patent is hereby corrected as shown below:

Column 10

Line 18, In Claim 2, delete “tapping” and insert -- taping --, therefor.
Line 18, In Claim 2, delete “liner” and insert -- linear --, therefor.
Line 21, In Claim 3, delete “tapping” and insert -- taping --, therefor.
Line 24, In Claim 4, delete “tapping” and insert -- taping --, therefor.
Line 27, In Claim 5, delete “tapping” and insert -- taping --, therefor.
Line 30, In Claim 5, delete “tapping” and insert -- taping --, therefor.
Line 31, In Claim 6, delete “tapping” and insert -- taping --, therefor.
Line 32, In Claim 6, delete “a” and insert -- the --, therefor.
Line 33, In Claim 7, delete “tapping” and insert -- taping --, therefor.
Line 33, In Claim 7, delete “liner” and insert -- linear --, therefor.
Line 50, In Claim 12, after “the” insert -- path of the --.
Line 52, In Claim 13, after “taping” insert -- head --.
Line 53, In Claim 13, after “guide” insert -- and --.
Lines 58-59, In Claim 14, after “arm,” delete “wherein the applying arm,”.
Line 61, In Claim 14, after “roller” insert -- connected --.

Column 11

Line 2, In Claim 14, delete “connnected” and insert -- connected --, therefor.

Signed and Sealed this
Twelfth Day of April, 2011

David J. Kappos

David J. Kappos
*Director of the United States Patent and Trademark Office*